US008202173B2

(12) United States Patent
Oldknow et al.

(10) Patent No.: US 8,202,173 B2
(45) Date of Patent: Jun. 19, 2012

(54) ANGLED CONNECTION FOR GOLF CLUB HEADS AND SHAFTS

(75) Inventors: Andrew G. V. Oldknow, Portland, OR (US); Philip J. Hatton, Portland, OR (US); Robert Boyd, Euless, TX (US)

(73) Assignee: NIKE, Inc., Beaverton, OR (US)

( * ) Notice: Subject to any disclaimer, the term of this patent is extended or adjusted under 35 U.S.C. 154(b) by 90 days.

(21) Appl. No.: 12/540,494

(22) Filed: Aug. 13, 2009

(65) Prior Publication Data

US 2011/0039631 A1 Feb. 17, 2011

(51) Int. Cl.
*A63B 53/02* (2006.01)

(52) U.S. Cl. ..... 473/288; 473/307; 473/248

(58) Field of Classification Search ..... 473/288, 473/307, 245–248
See application file for complete search history.

(56) References Cited

U.S. PATENT DOCUMENTS

| | | | | | |
|---|---|---|---|---|---|
| 1,529,959 | A | * | 3/1925 | Martin | 473/245 |
| 1,695,291 | A | | 12/1928 | Muller | |
| 1,927,083 | A | | 9/1933 | Davis | |
| 2,219,670 | A | * | 10/1940 | Wettlaufer | 473/247 |
| 2,425,808 | A | * | 8/1947 | Jakosky | 473/246 |
| 4,174,108 | A | * | 11/1979 | Reinholz | 473/247 |
| 4,512,577 | A | | 4/1985 | Solheim | |
| 4,632,400 | A | | 12/1986 | Boone | |
| D295,206 | S | | 4/1988 | Perkins | |
| 5,039,098 | A | * | 8/1991 | Pelz | 473/306 |
| 5,324,033 | A | * | 6/1994 | Fenton, Jr. | 473/305 |
| 5,626,528 | A | | 5/1997 | Toulon | |
| 5,695,409 | A | | 12/1997 | Jackson | |
| 5,951,411 | A | * | 9/1999 | Wood et al. | 473/307 |
| 6,095,929 | A | * | 8/2000 | Clark | 473/248 |
| 6,120,384 | A | | 9/2000 | Drake | |
| 6,186,903 | B1 | | 2/2001 | Beebe et al. | |
| 6,769,994 | B2 | | 8/2004 | Boone | |
| 6,991,559 | B2 | | 1/2006 | Yabu | |
| 7,938,735 | B2 | * | 5/2011 | Lau | 473/288 |
| 2002/0037773 | A1 | * | 3/2002 | Wood et al. | 473/246 |
| 2003/0220149 | A1 | * | 11/2003 | Mills | 473/246 |

(Continued)

FOREIGN PATENT DOCUMENTS

| | | | |
|---|---|---|---|
| JP | 04327865 | A * | 11/1992 |
| JP | 8150228 | A | 6/1996 |
| JP | 2001054594 | * | 2/2001 |

(Continued)

OTHER PUBLICATIONS

International Search Report and Written Opinion issued Dec. 20, 2010 in related PCT Application No. PCT/US2010/045252.

*Primary Examiner* — Stephen L. Blau
(74) *Attorney, Agent, or Firm* — Banner & Witcoff, Ltd.

(57) ABSTRACT

A golf club having a shaft, a club head and a connection region structure provides an angled connection of the shaft to the club head. The connection region structure includes a first end, a second end and a bore extending from the first end toward the second end. The first end has an opening to receive the distal end of the shaft. The second end is opposite to the first end and includes a mounting surface. The bore receives the distal end of the shaft and defines a longitudinal axis. The mounting surface is at a non-zero angle to a perpendicular to the longitudinal axis of the bore. Further, the mounting surface abuts the first surface of a shaft-attachment structure that projects from a main body of the club head.

32 Claims, 4 Drawing Sheets

U.S. PATENT DOCUMENTS

| | | | | |
|---|---|---|---|---|
| 2005/0049066 | A1 | 3/2005 | Schweigert | |
| 2006/0264266 | A1 * | 11/2006 | Jung | 473/282 |
| 2008/0102977 | A1 | 5/2008 | Huang et al. | |
| 2008/0167137 | A1 | 7/2008 | Burnett et al. | |
| 2008/0280696 | A1 * | 11/2008 | Lau | 473/310 |

FOREIGN PATENT DOCUMENTS

| | | | | |
|---|---|---|---|---|
| JP | 2001054594 | A | | 2/2001 |
| JP | 2002035177 | A | * | 2/2002 |
| JP | 2002052102 | A | * | 2/2002 |
| WO | 99/36134 | A1 | | 7/1999 |

* cited by examiner

ANGLED CONNECTION FOR GOLF CLUB HEADS AND SHAFTS

FIELD OF THE INVENTION

This invention relates generally to golf clubs and golf club heads. More particularly, aspects of this invention relate to golf clubs having angled connections between the golf club head and the shaft.

BACKGROUND

Golf is enjoyed by a wide variety of players—players of different genders and dramatically different ages and/or skill levels. Golfers at all skill levels seek to improve their performance, lower their golf scores, and reach that next performance "level." One way to improve performance is to use more technologically advanced equipment. A further way to improve performance is to select equipment that matches an individual golfer's style.

Golf clubs have been the subject of much technological research and advancement in recent years. Certain technological advancements have been made in an effort to better match the various elements and/or characteristics of the golf club and characteristics of a golf ball to a particular user's swing characteristics (e.g., club fitting technology, ball launch angle measurement technology, ball spin rates, etc.). There now exists a vast array of golf club component parts available to the golfer. For example, individual club head models may include variations in the loft angle, lie angle, offset features, weighting characteristics, etc. These various club heads may be combined with a variety of shafts having, for example, any of various stiffnesses, flex points, kick points or other flexion characteristics. Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Not only should the individual golf head and shaft be selected based on the specific golfer's swing characteristics, but the angle at which the shaft is fitted to the head, i.e. the lie angle, should also be matched to the individual golfer's physical characteristics.

Lie is the angle between the center line of the hosel and the sole of the club head when the sole is touching the ground at the center of the face scoring area. If the center of the face scoring area of the club head is on the ground when a golfer stands at address then the lie of the club is generally considered perfect—this is termed a "standard" lie. If the toe of the club head points in the air and the heel of the club head is on the ground, then the golfer's lie is too "upright" and should be made flatter. In contrast, if the heel of the club head is in the air and the toe is on the ground, then the golfer's lie is too "flat" and should be made more upright. Shorter players generally use a flatter lie angle; taller players generally use a more upright lie angle.

The lie of the club can have a significant impact on ball flight. If the lie is too flat for a particular golfer, the toe of the club head may impact the ground first and the ball flight may tend to the right. If the lie of the club is too upright for the golfer, the ball flight may tend to the left.

Conventionally, shafts are mounted to golf club heads using hosels. In some instances, custom-fitting of golf clubs to an individual golfer has involved bending the hosel to provide the correct lie angle for that golfer/club combination. This is typically undesirable. First, the hosel, which is a structural connection between the shaft and the club head, may optimally have material properties that are not amenable to bending. Further, bending may result in deformation of the hosel and some attendant loss of strength and/or stiffness.

In other instances, particularly with drivers, the shaft may be inserted into a bore within the club head. By providing club heads with various bore angles, the lie angle of the club may also be varied. As each club head can only accommodate a single bore angle, and correspondingly can only accommodate a single lie angle, this system does not make efficient use of the golf club components that must be stocked by golf club customizers.

The disadvantages associated with these conventional options serve to limit the choices available to a golfer during a custom-fitting session and/or to reduce the technical performance of the golf club.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In accordance with illustrative aspects of the invention, a shaft-golf head connection provides an angled connection for attaching a selected golf club shaft with a selected golf club head. The angled connection can facilitate custom club design and fitting to suit the needs and preferences of an individual golfer.

Illustrative aspects of this invention relate to apparatus, systems and methods for connecting golf club heads to shafts so that any of various lie angles of the shaft with respect to the club head body (and its ball striking face) can be readily achieved. Golf clubs with club head/shaft connection assemblies in accordance with examples of this invention may include: a shaft having a proximal end and a distal end; a club head having a shaft-attachment structure that projects from a main body of the club head, the shaft-attachment structure defining a first external surface; and a connection region structure connecting the shaft to the club head, the connection region structure including: a first end including an opening receiving the distal end of the shaft; a second end opposite to the first end and including a mounting surface; a bore extending from the first end toward the second end, wherein the bore receives the distal end of the shaft, wherein the bore defines a longitudinal axis; and wherein the mounting surface is at a non-zero angle to a perpendicular to the longitudinal axis of the bore, and wherein the mounting surface is secured the first external surface of the shaft-attachment structure.

BRIEF DESCRIPTION OF THE DRAWINGS

A more complete understanding of the present invention and certain advantages thereof may be acquired by referring to the following detailed description in consideration with the accompanying drawings, in which.

Figure 1:
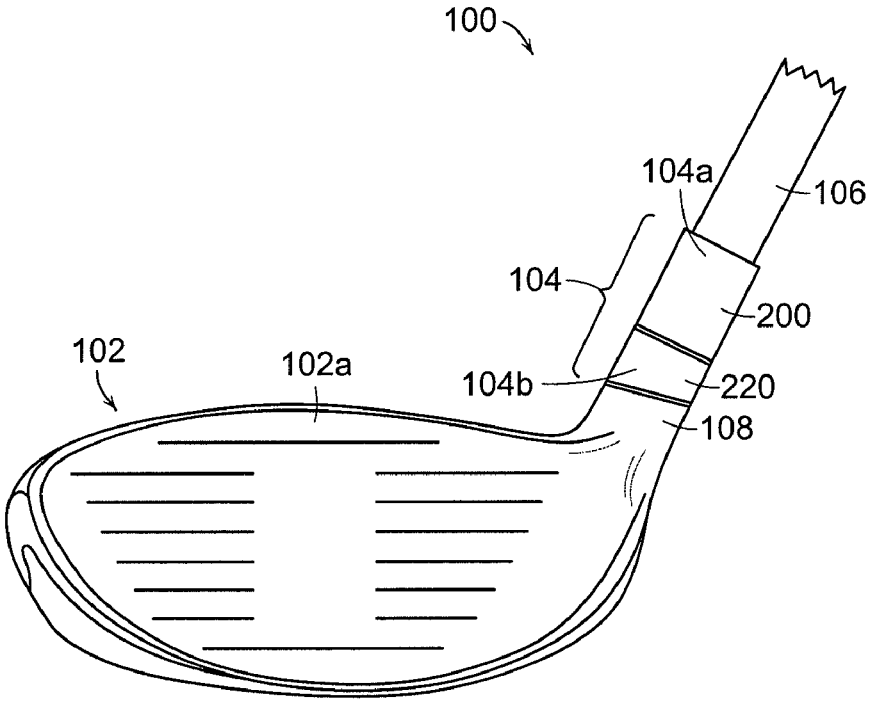
FIG. 1 generally illustrates a front view of a portion of an example golf club according to an aspect this invention.

The reader is advised that the attached drawings are not necessarily drawn to scale and that certain features may have been exaggerated in or removed from the drawings for purposes of discussion.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Angled Connections and Golf Clubs Including Such Connections According to Examples of the Invention In general, as described above, aspects of this invention relate to systems and methods for connecting golf club heads to shafts so that the club heads and shafts can be oriented at various lie angles with respect to one another. More detailed descriptions of aspects of this invention follow.

1. Example Angled Connections and Golf Club Structures According to the Invention A golf club having a shaft, a club head and a connection region structure provides an angled connection of the shaft to the club head and is described herein. The connection region structure includes a first end, a second end and a bore extending from the first end toward the second end. The first end has an opening to receive the distal end of the shaft. The second end is opposite to the first end and includes a mounting surface. The bore receives the distal end of the shaft and defines a longitudinal axis. The mounting surface is at a non-zero angle to a perpendicular to the longitudinal axis of the bore. Further, the mounting surface is configured to abut a first surface of a shaft-attachment structure that projects from a main body of the club head.

The non-zero angle of the mounting surface may provide an adjustment angle from the standard lie angle of up to 25 or more degrees. More typically, an adjustment angle would range between 1 and 10 degrees, or even between 1 and 5 degrees, although ranges of between 0.5 and 15 degrees, or even between 0.25 and 25 degrees are within the scope of the present invention. Large and small adjustment angles from the standard lie angle may be provided by the present invention, including, for example, adjustment angles of from at least 0.25 degrees, at least 0.5 degrees, at least 1 degree, at least 2 degrees, at least 4 degrees, or even at least 8 degrees.

One aspect of this invention relates to the connection region structure for the golf club. Such connection region structures may be supplied as part of a system, wherein a plurality of connection region structures having various lie angle adjustment angles may be used to provide a golfer with a selection of lie angle adjustment angles. Such connection region structures may include, for example: a first end including an opening that is configured to receive a distal end of a golf club shaft; a second end opposite to the first end, the second end including a mounting surface configured to abut a first surface of a golf club head; a bore extending from the first end toward the second end, wherein the bore is configured to receive the distal end of the golf club shaft and wherein the bore defines a longitudinal axis; an outer surface extending from the first end toward the second end, wherein the outer surface is parallel to the longitudinal axis of the bore; and wherein the mounting surface is at a non-zero angle to a perpendicular to the longitudinal axis of the bore. In accordance with this aspect, as the outer surface is parallel to the longitudinal axis of the bore that accommodates the shaft, a consistent, clean, streamlined look between the shaft and the connection region structure can be achieved. This parallelism between the outer surface and the longitudinal axis of the bore may be maintained even if the angle of the mounting surface changes.

According to certain examples of the various aspects of the present invention, the connection region structure may be formed from more than one component. For example, the connection region structure may include a hosel and a wedge grommet. Alternatively, according to other examples, the connection region structure may be provided as a single integral component. The integral component may be formed as a unitary part, or alternatively, the integral component may be formed as multiple parts that are subsequently permanently (or quasi-permanently) assembled. In one example, the connection region structure may include a hosel without any accompanying grommet.

One aspect of the connection region structure provided herein, in accordance with examples of the present invention, is that the connection region structure is located externally of the golf club head. In this aspect, the connection region structure extends between the golf club shaft and a shaft-attachment structure that project from the golf club head. The connection region structure provides a simple, streamlined coupling between the shaft and the club head that does not require that the shaft extend into the club head. An end surface of the connection region structure may be connected to an end surface of the shaft-attachment structure with a single threaded fastener. In this respect, the connection region structure described herein may be particularly applicable to iron-type club heads.

Thus, another aspect of this invention relates to a connection region structure including, for example: a first end including an opening that is configured to receive a distal end of a golf club shaft; a second end opposite to the first end, the second end including a mounting surface configured to be securely fastened to a first external surface of a golf club head; a bore extending from the first end toward the second end, wherein the bore is configured to receive the distal end of the golf club shaft and wherein the bore defines a longitudinal axis; and wherein the mounting surface is at a non-zero angle to a perpendicular to the longitudinal axis of the bore. The mounting surface of the connector region structure may be fastened to the end surface of a shaft-attachment structure that projects from the main body of the club head.

According to certain examples of the various aspects of the present invention, the connection region structure may be attached to the club head with a single fastener that extends from the connector region structure, through a hole in second end of the connector region structure, and into a hole in the surface of the shaft-attachment structure. According to other examples, the connection region structure may be attached to the club head with multiple fasteners. One or more of the fasteners may, for example, be aligned with the longitudinal axis of the golf club shaft. Alternatively, one or more of the fasteners may be aligned with a longitudinal axis that corresponds to a standard lie angle. According to even further examples, one or more of the fasteners may be aligned transversely to the longitudinal axes. The fasteners may be threaded for engaging corresponding threaded holes. Alternatively, the fasteners may include keyways, splines, detent mechanisms, elastic or plastic interference fits, etc.

According to one aspect of the connector region structure as described herein, the use of mechanical fasteners may facilitate the fastening and the unfastening of the shaft from the club head. In this aspect, the connector region structure may be releasably attachable to the club head. In a system, wherein a plurality of connector region structures is supplied, the connector region structures may be releasably and interchangeably attachable to the club head. Other methods may be used, apart from or in concert with mechanical fasteners, to attach the connector region structures to the club head. For example, releasable or permanent adhesives may be applied to one or more of the corresponding mounting surfaces of the second end of the connector region structure or of the shaft-attachment structure of the club head. As other examples, more permanent attachments could be provided by brazing, welding, etc.

In some example golf club head/shaft connection assemblies in accordance with the invention, the second end of the connection region structure and/or the mounting surface of the club head may include rotation-inhibiting elements. The rotation-inhibiting elements may take on a wide variety of forms and still be in accordance with this invention. In some example structures, the rotation-inhibiting structure may be integrally formed as a unitary structure with one of the corresponding mounting surfaces. For example, the connection region structure may include a tab or other projection that longitudinally extends from the second end and that is configured to be received into a slot or channel formed on the club head. A person of ordinary skill in the art, given the benefit of the present disclosure, would recognize that the projection or tab could be formed on the club head and that the corresponding slot could be formed in the connection region structure. In other example structures according to certain aspects of the present invention, the rotation-inhibiting elements could be formed separately and subsequently incorporated into the connection region structure and/or the club head. By way of non-limiting example, a shear pin could be inserted into a hole drilled into the mounting surface of the connection region structure. According to another aspect of the present invention, the rotation-inhibiting structure may also function as an alignment guide, to insure that the connection region structure is properly aligned with the club head. These features can help keep the overall connection assembly relatively compact and lightweight, while facilitating alignment and rotational stiffness.

Aspects of this invention relate to the connection region structures, golf club structures that incorporate the connection region structures, and systems utilizing the connection region structures will be described in more detail below.

2. Example Methods of Assembling Golf Clubs Including Angled Connections According to the Invention Another aspect of this invention relates to methods of assembling golf clubs using angled connection region structures in accordance with examples of this invention. Such methods may include: inserting a golf club shaft into a connection region structure having a first end including an opening that is configured to receive a distal end of the golf club shaft, a second end opposite to the first end, the second end including a mounting surface configured to abut a shaft-attachment structure of a golf club head, a bore extending from the first end toward the second end, wherein the bore is configured to receive the distal end of the golf club shaft and wherein the bore defines a longitudinal axis, wherein the mounting surface is at a non-zero angle to the perpendicular to the longitudinal axis of the bore; and securing the second end of the connection region structure to the shaft-attachment structure, wherein the shaft-attachment structure projects from a main body of a golf club head.

The method may include releasably securing the second end of the connection region structure to the shaft-attachment structure.

The method may further include slidably engaging the second end of the connection region structure to the shaft-attachment structure. In one aspect, rotation-inhibiting structure provided on the second end of the connection region structure may be slidably engaged with a rotation-inhibiting structure provided on the shaft-attachment structure.

In such structures, the lie angle could be quickly and easily adjusted by detaching the connection region structure from the shaft and from the club head and interchangeably replacing it with another connection region structure having a different lie angle adjustment angle. Furthermore, if desired, the shaft could be quickly and easily exchanged for a different shaft on the club head body (e.g., a shaft of different length, different flex characteristics, different material, etc.). Additionally or alternatively, if desired, in such structures, the club head can be quickly and easily exchanged Specific examples of the invention are described in more detail below. The reader should understand that these specific examples are set forth merely to illustrate examples of the invention, and they should not be construed as limiting the invention.

B. Specific Examples of the Invention

Figure 2:
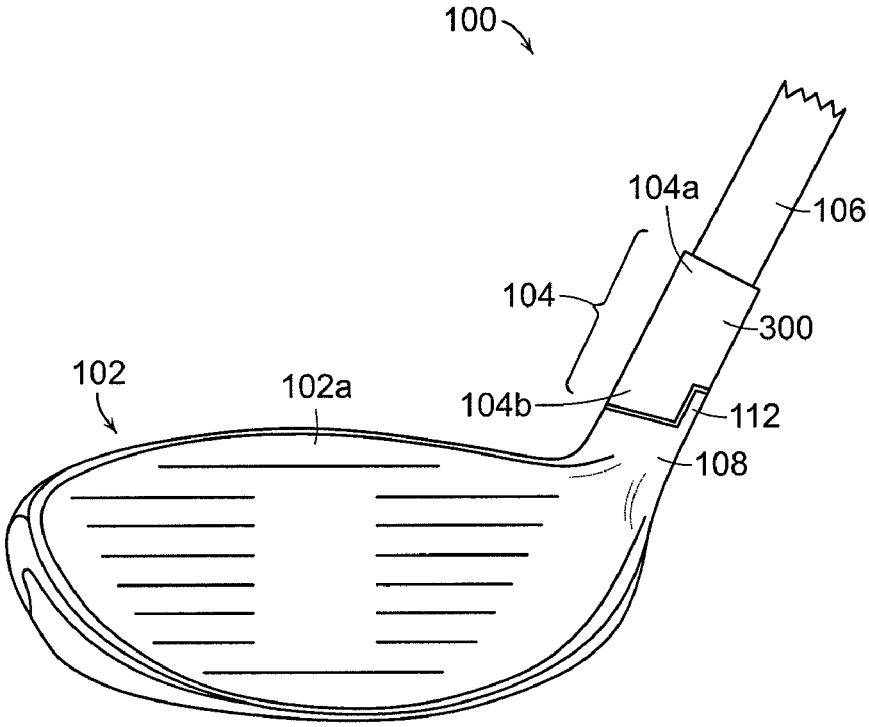
FIG. 2 generally illustrates a front view of a portion of an example golf club according to another aspect this invention.
Figure 3:
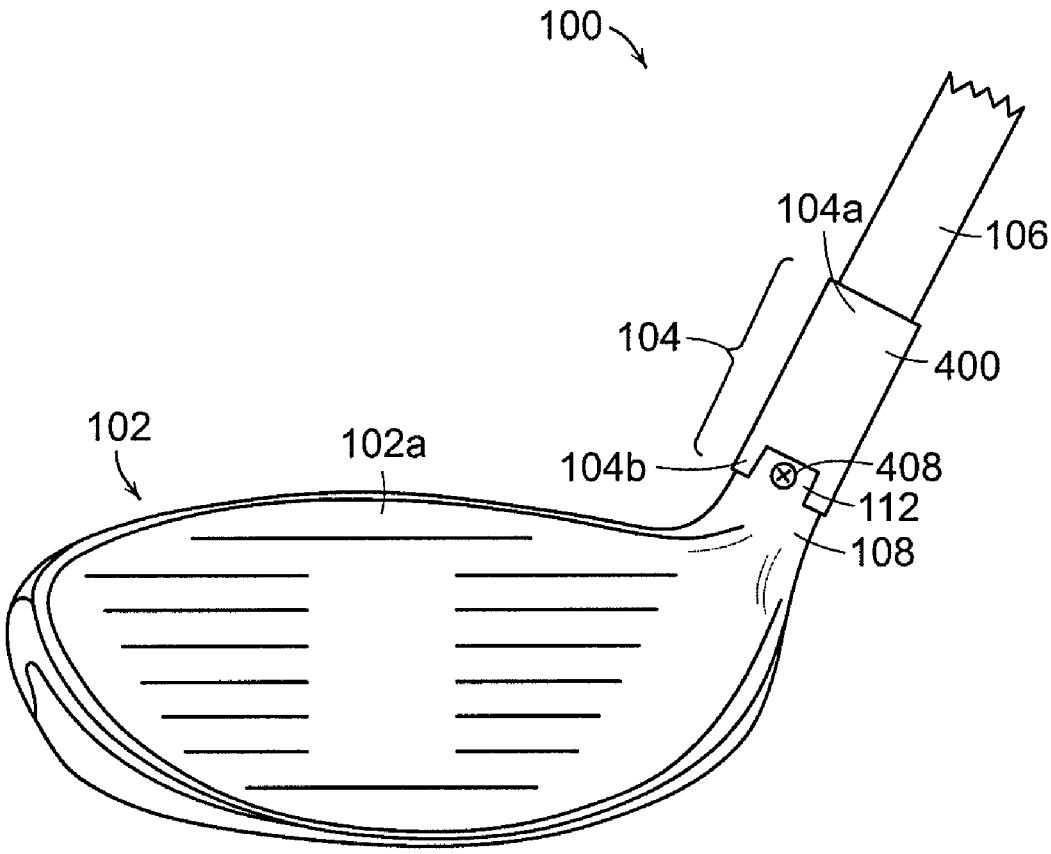
FIG. 3 generally illustrates a front view of a portion of an example golf club according to a further aspect this invention.

FIGS. 1, 2 and 3 generally illustrate example golf clubs 100 in accordance with at least certain aspects of this invention. The club 100 includes a club head 102, a club shaft 106, and a club head/shaft connection region structure 104 that connects the club head 102 to the shaft 106. Optionally, a grip member (not shown) may be provided at the proximal end of the shaft 106.

Club head 102 includes a main body 102*a* that extends from a heel region to a toe region. A shaft-attachment structure 108, which projects from the main body 102*a*, is provided at the heel region of the club head 102. The shaft-attachment structure 108 is configured to allow the distal end of shaft 106, via the connection region structure 104, to be coupled to club head 102. While a driver/wood-type golf club head 102 is illustrated in these figures, aspects of this invention may be applied to any type of club head, including, for example: fairway wood club heads; iron type golf club heads (of any desired loft, e.g., from a 0-iron or 1-iron to a wedge);

wood or iron type hybrid golf club heads; putter heads; and the like. The club heads may be made from conventional materials, in conventional constructions, in conventional manners, as are known and used in the art, optionally modified (if necessary, e.g., in size, shape, etc.) to accommodate the club head/shaft connection region parts described herein.

Any desired materials also may be used for the shaft 106, including conventional materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection region parts described herein.

The club head/shaft connection region structure 104 extends from a first end 104*a* to a second end 104*b*. A shown in FIG. 1, the first end 104*a* is coupled to the shaft 106 and the second end 104*b* is coupled to club head 102. The connection region structure 104 allows the shaft 106 to be connected to the club head 102 at any of various lie angles. Generally any desired lie angle adjustment may be accommodated without departing from this invention, e.g., at least 0.25 degrees, at least 0.5 degrees, at least 1 degree, at least 2 degrees, at least 4 degrees, or even at least 8 degrees. In some example structures, the desired lie angle adjustment angle will be between 0.25 and 25 degrees, between 0.5 and 15 degrees, between 1 and 10 degrees, or even between 1 and 5 degrees.

This connection region structure 104 between golf club heads 102 and shafts 106 in accordance with some examples of this invention now will be described in more detail in conjunction with FIGS. 4 through 7.

Figure 4:
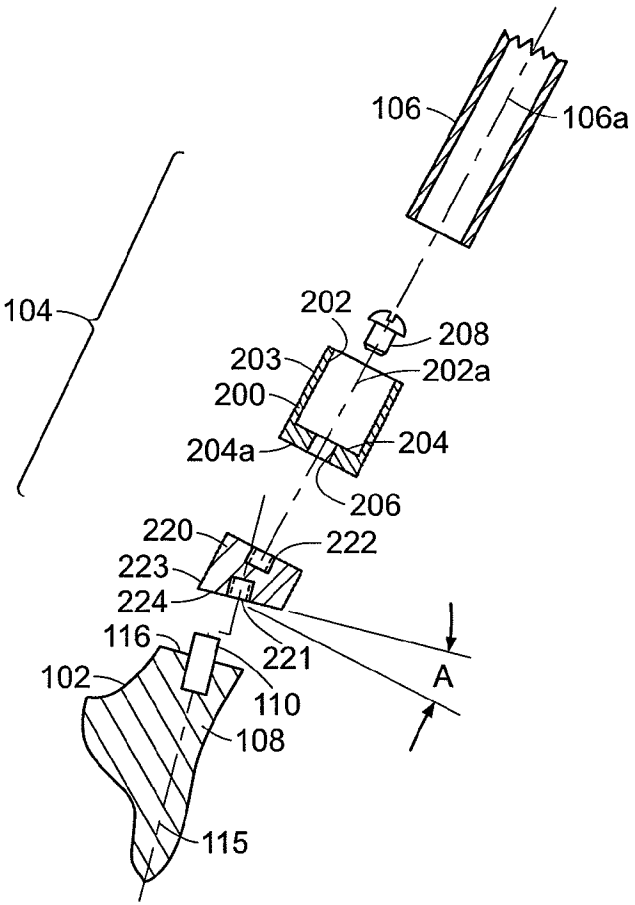
FIG. 4 illustrates an exploded sectional view of an example golf club head/shaft connection region assembly in accordance with this invention and the aspect of FIG. 1.

FIG. 4 illustrates an exploded section view of the parts involved in the connection region structure 104 in accordance with this invention and with the embodiment of FIG. 1. As shown in FIG. 1 and FIG. 4, this example connection region structure 104 includes two main parts, namely: a hosel 200 and wedge grommet 220. The shaft 106 is coupled to the hosel 200, which is coupled to the wedge grommet 220, which is coupled to the club head 102.

As best shown in FIG. 4, the hosel 200 includes an inner bore 202 having a longitudinal axis 202*a*. The longitudinal axis 202*a* corresponds to a longitudinal axis 106*a* of the shaft 106. The inner bore 202 is configured to accommodate the distal end of the shaft 106. An outer surface 203 is provided that extends parallel to the longitudinal axis 202*a* of the inner bore 202. In this example, both inner bore 202 and outer surface 203 are cylindrical. The hosel 200 further includes an end wall 204 that closes off the end of bore 202 at the end of hosel 200 that is adjacent the wedge grommet 220. The end wall 204 includes a through hole 206 configured to accommodate the shank of a mounting screw 208. The end wall 204 may include a countersunk portion to accommodate the head of mounting screw 208. An outer surface 204*a* of end wall 204 is perpendicular to the longitudinal axis 202*a*.

The wedge grommet 220 includes an inner bore 222 aligned along the same longitudinal axis 202*a* associated with the inner bore 202 of the hosel 200. Thus, as shown in FIG. 4, the hosel 200 is provided with a hosel-to-wedge grommet attachment element that is aligned with the longitudinal axis of the inner bore 202. Specifically, in this example embodiment, the inner bore 222 of wedge grommet 220 is a part-through hole and is configured to accommodate a threaded portion of the mounting screw 208. An outer surface 223 is provided on the wedge grommet 220. In this example, outer surface 223 extends parallel to the longitudinal axis 202*a* of the inner bore 202 and is cylindrical. The wedge grommet 220 defines an angled surface 224 on the end of the wedge grommet 220 that is opposite the hosel 200. The angled surface 224 defines an angle A with respect to a perpendicular to the longitudinal axis 202*a*. The angle A corresponds to the desired increase or decrease in lie angle from the standard lie angle. The wedge grommet 220 can be of any suitable length. By way of non-limiting example, the wedge grommet 220 could have a longitudinal length, as measured along a centerline or along the longitudinal axis of the bore, that ranges from approximately 0.1 inches to approximately 0.5 inches.

The wedge grommet 220 is configured to be attached to the club head 102. As shown in FIG. 4, the wedge grommet 220 is provided with a wedge grommet-to-golf club head attachment element that is aligned with the longitudinal axis associated with the standard lie angle. Specifically, in this embodiment, the wedge grommet 220 is configured to be attached to a shaft-attachment structure 108 that projects upwardly from the main body 102*a* of the club head 102. The shaft-attachment structure 108 includes a mounting surface 116. The mounting surface 116 of the club head 102 is perpendicular to an axis 115 that is aligned with the standard lie angle. The shaft-attachment structure 108 further may include a pin 110 extending from the surface 116 and aligned parallel to axis 115. The pin 110 is configured to engage a part-through bore 221 that is formed in surface 224 of the wedge grommet 220, thereby attaching the wedge grommet 220 to the main body 102*a*. Both the pin 110 extending from surface 116 and the part-through bore 221 formed in surface 224 are aligned parallel to axis 115. The pin 110 and the part-through bore 221 may both be threaded. As an alternative example, the pin 110 may extend from the wedge grommet 220 for insertion into a corresponding hole in the main body 102*a*.

At the attachment of the wedge grommet 220 to the club head 102, the angled surface 224 abuts the mounting surface 116. Since a perpendicular to the angled surface 224 is not aligned with the longitudinal axis 106*a* of the shaft 106, and since a perpendicular to the mounting surface is aligned with a standard lie angle, abutting the angled surface 224 up against the mounting surface 116 causes the longitudinal axis 106*a* of the shaft 106 to depart from the standard lie angle. The angle A associated with the angled surface 224 determines by how much the longitudinal axis 106*a* of the shaft 106 departs from the standard lie angle.

At the attachment of the wedge grommet 220 to the club head 102, the lateral external cross-section of the wedge grommet 220 may be the same as the lateral external cross-section of the shaft-attachment structure 108. Thus, the external lateral surface of the wedge grommet 220 may be substantially aligned with the external lateral surface of the shaft-attachment structure 108. Even further the lateral external cross-section of the hosel 200 may be the same as the wedge grommet 220. This provides a smooth, clean, unstepped, appearance in the connection region. Non-limiting examples of cross-sections for the hosel 200, the wedge grommet 220 and the shaft-attachment structure 108 include circles, ovals, hexagons, and other regular polygons. Additionally, as the external lateral surface of the connection region structure 104 does not interact with other structures in the aspect illustrated in FIGS. 1 and 4, there is no need for projections extending laterally from the external lateral surfaces of the hosel 200, the wedge grommet 220 or the shaft-attachment structure 108. Again, this provides a smooth, clean, appearance in the connection region.

The smooth, clean lines of the connection region structure 104 are further enhanced by having the outer surface 203 of the hosel 200 extending parallel to the longitudinal axis 202*a* of the bore 202. As the shaft 106 is received within the bore 202, the outer surface 203 extends parallel to the shaft 106. No visible change in angle is to be detected between the shaft 106 and the hosel 200. Further, as the inner bore 202 and the outer surface 203 are oriented parallel to one another, manufacture of the hosel 200 may be facilitated. For example, the hosel may be formed of an extruded tube such that the inner bore 202 and the outer surface 203 are formed simultaneously, as opposed to having the inner bore 202 drilled from a hosel blank.

Figure 5:
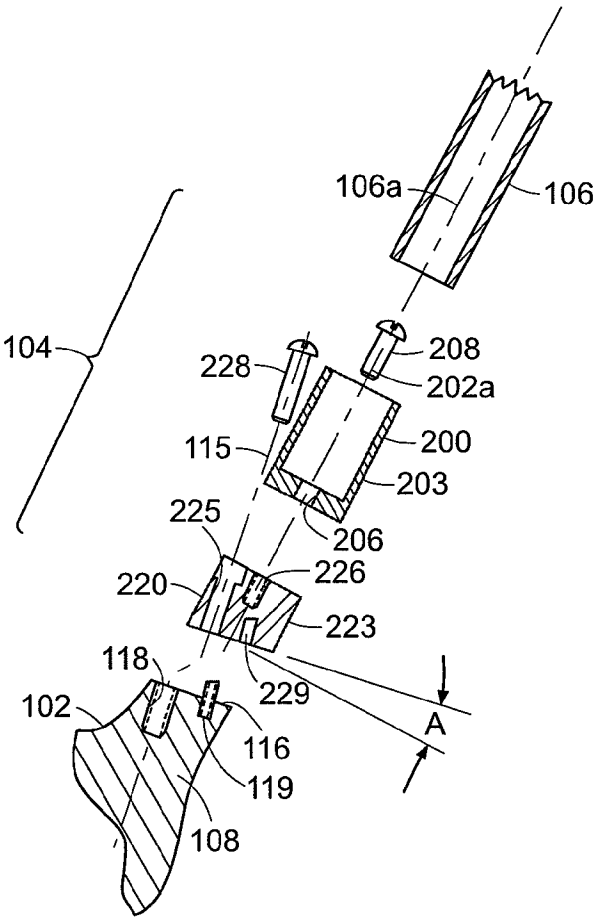
FIG. 5 illustrates an exploded sectional view of another example golf club head/shaft connection region assembly in accordance with this invention and the aspect of FIG. 1.

FIG. 5 illustrates an exploded section view of an alternative mounting configuration of the parts involved in the connection region structure 104 in accordance with this invention and with the embodiment of FIG. 1. In FIG. 5, the mounting screw 208, which is aligned with the longitudinal axis 202*a* extends through the hole 206 and into the threaded hole 226 provided in the wedge grommet 220. The wedge grommet 220 is fastened to the club head 102 with a grommet mounting screw 228. The wedge grommet 220 is provided with a through hole 225 to allow the grommet mounting screw 228 to extend through the wedge grommet 220 and into a threaded hole 118 provided in the club head 102. The through hole 225 and the threaded hole 118 are both aligned with longitudinal axis 115. Longitudinal axis 115 represents the standard lie angle and is perpendicular to the mounting surface 116 of the club head 102.

To assist in properly aligning and orienting the wedge grommet 220 with the club head 102 and also to assist in inhibiting the rotation of the wedge grommet 220 relative to the club head 102, an orienting element 119 may be provided on the club head 102. In this example, the orienting element is a shear pin that extends perpendicularly from the mounting surface 116. A corresponding orienting element 229 is provided in the wedge grommet 220. In this example, the orienting element 229 is a bore that is configured to receive the shear pin.

In general, relative rotation between the wedge grommet 220 and the club head 102 and/or between the hosel 200 and the wedge grommet 220 may be inhibited or prevented by other suitable elements, as would be apparent to persons of ordinary skill in the art given the benefit of this disclosure. Similarly, the proper orientation of the wedge grommet 220 to the club head 102 may be achieved by other suitable elements, as would also be apparent to persons of ordinary skill in the art given the benefit of this disclosure. By way of non-limiting example, such elements may include shear pins, off-axis fasteners, adhesives, fusing techniques, friction fits, detent mechanisms, etc.

In the examples described above and illustrated in FIGS. 4 and 5, the hosel 200 and the wedge grommet 220 are mechanically fastened to the club head 102. In general, however, the hosel 200 and the wedge grommet 220 may be permanently or releasably secured to the club head 102 in any desired manner, e.g., via cements or adhesives; via welding, brazing, soldering, or other fusing techniques; via mechanical connectors; via a friction fit; etc.

To attach the shaft 106 to the club head 102 at a desired lie angle, the wedge grommet 220 having the desired lie angle adjustment is selected and both the hosel 200 and the wedge grommet 220 are attached to the club head 102. The hosel 200 and the wedge grommet 220 could be releasably attached to the club head 102, for example, using threaded pin 110 as described above with reference to FIG. 4. The user could determine if the selected wedge grommet 220 provides the proper lie angle for that user. If not, the hosel 200 and the wedge grommet 220 could be removed from the club head 102 by unscrewing the wedge grommet 220 from the threaded pin 110. Further, the wedge grommet 220 may be dis-engaged from the hosel 200 by unscrewing the mounting screw 208 from the wedge grommet 220. Then, a wedge grommet 220 having a different lie angle adjustment could then be selected and attached to the club head 102. In this manner, the shaft 106 could be quickly and easily engaged with the club head 102 at a variety of lie angles.

Alternatively, if desired, once the wedge grommet 220 having the proper lie angle adjustment is selected, the wedge grommet 220 and/or the hosel 200 could be permanently mounted to the club head 102. For example, an epoxy could be applied to the threads of the mounting screw 208 prior to threading the mounting screw 208 into the threaded hole 222, an epoxy could be applied to the pin 110 prior to inserting the pin 110 into the hole 221, and/or an epoxy could be applied to at least one of the mounting surfaces 224 or 116.

The hosel 200 and the wedge grommet 220 may be made from conventional materials, in conventional constructions, in conventional manners, as are known and used in the art.

Figure 6:
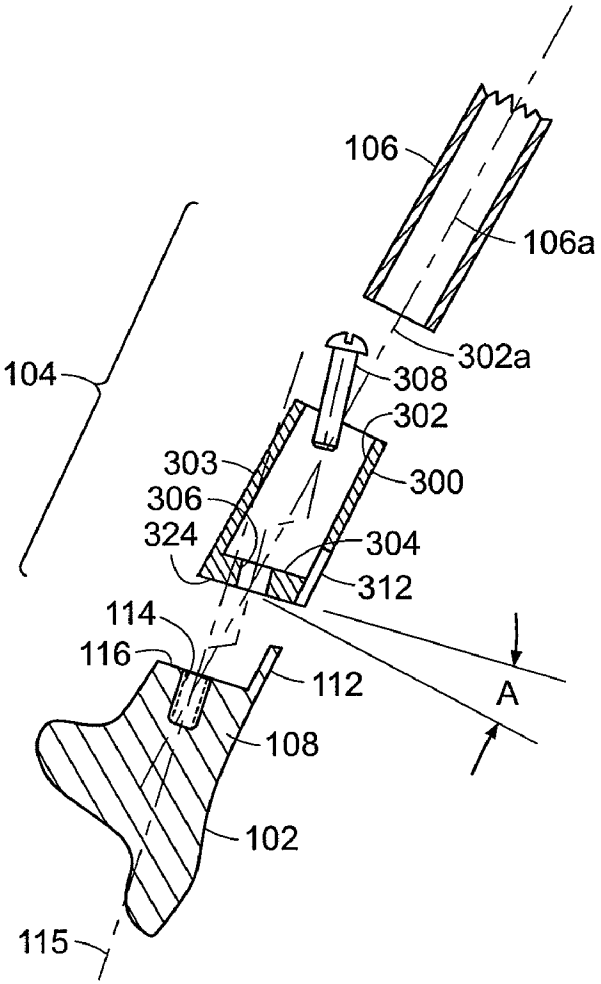
FIG. 6 illustrates an exploded sectional view of an example golf club head/shaft connection region assembly in accordance with this invention and the aspect of FIG. 2.

FIG. 6 illustrates an exploded section view of the parts involved in the connection region structure 104 in accordance with this invention and with the embodiment of FIG. 2. As shown in FIG. 2 and FIG. 6, this example connection region structure 104 includes one main part, namely: a hosel 300. As best shown in FIG. 6, the hosel 300 includes an inner bore 302 having a longitudinal axis 302*a*. The longitudinal axis 302*a* corresponds to a longitudinal axis 106*a* of the shaft 106. The inner bore 302 is configured to accommodate the distal end of the shaft 106. An outer surface 303 is provided on the hosel 300. In this example, outer surface 303 extends parallel to the longitudinal axis 302*a* of the inner bore 302 and is cylindrical. The hosel 300 further includes an end wall 304 that closes off the end of bore 302. The end wall 304 includes a through hole 306 configured to accommodate the shank of a mounting screw 308. The end wall 304 may include a countersunk portion to accommodate the head of the mounting screw 308.

The hosel 300 defines an angled surface 324 on the end of the hosel 300 that abuts a mounting surface 116 provided on the club head 102. The angled surface 324 defines an angle A with respect to a perpendicular to the longitudinal axis 302*a*. The angle A corresponds to the desired increase or decrease in lie angle from the standard lie angle, which is aligned with longitudinal axis 115. Thus, in at least some aspects, the hosel 300 includes certain features of the hosel 200 and certain features of the wedge grommet 220, as discussed above.

The club head 102 includes a threaded hole 114 configured to accommodate the threaded portion of mounting screw 308. In the example embodiment of FIG. 6, the threaded hole 114 of club head 102 is longitudinally aligned with the longitudinal axis 115 that corresponds in alignment to the standard lie angle. As shown in FIG. 6, the longitudinal axis 115 of the threaded hole 114 is perpendicular to the mounting surface 116 of club head 102.

Because the angled surface 324 of the hosel 300 and the corresponding mounting surface 116 of the club head 102 are perpendicular to the longitudinal axis 115 of the threaded hole 114, the hosel 300 and the club head 102 may be prone to rotate relative to one another around axis 115. To inhibit this relative rotation, the hosel 300 further includes a rotation-inhibiting element 312 that complements a corresponding rotation-inhibiting element 112 provided on the club head 102. The complementary rotation-inhibiting elements 312, 112 operate together to prevent undesired rotation of the hosel 300 relative to the club head 102. As shown in FIGS. 2 and 6, the rotation-inhibiting element 312 is configured as a notch or slot in the outer wall of the hosel 300. The rotation-inhibiting element 112 is configured as a projection having a cross-section that allows it to be received within the confines of the rotation-inhibiting element 312. Thus, in this particular embodiment, when the hosel 300 is mated to the club head 102, the rotation-inhibiting element 112 is slidingly received by the rotation-inhibiting element 312. The interaction between the two rotation-inhibiting elements 312, 112 prevents or inhibits rotation of the hosel 300 around its longitudinal axis 302*a* relative to the club head 102.

Elements 312 and 112 also may serve to properly orient the hosel 300 relative to the club head 102.

In general, relative rotation between the hosel 300 and the club head 102 may be inhibited or prevented by other suitable elements, as would be apparent to persons of ordinary skill in the art given the benefit of this disclosure. Similarly, the proper orientation of the hosel 300 to the club head 102 may be achieved by other suitable elements, as would also be apparent to persons of ordinary skill in the art given the benefit of this disclosure. By way of non-limiting example, such elements may include shear pins, off-axis fasteners, adhesives, fusing techniques, friction fits, detent mechanisms, etc.

To attach the shaft 106 to the club head 102 at a desired lie angle, the hosel 300 having the desired lie angle adjustment is selected and attached to the club head 102. The hosel 300 could be releasably attached to the club head 102, for example, using mounting screw 308. The user could determine if the selected hosel 300 provides the proper lie angle for that user. If not, the hosel 300 could be removed from the club head 102 by unscrewing the mounting screw 308. A hosel 300 having a different lie angle adjustment could then be selected and attached to the club head 102. If desired, once the hosel 300 having the proper lie angle adjustment is selected, the hosel 300 could be permanently mounted to the club head 102. For example, an epoxy could be applied to the threads of the mounting screw 308 prior to threading the mounting screw 308 into the threaded hole 114 or an epoxy could be applied to at least one of the mounting surfaces 324 or 116.

Figure 7:
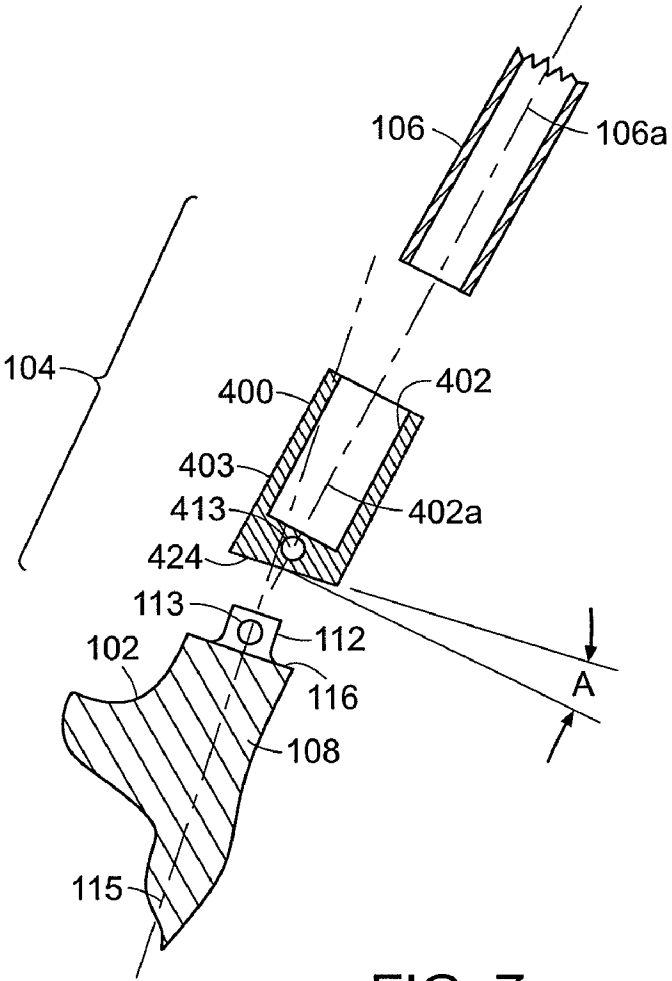
FIG. 7 illustrates an exploded sectional view of an example golf club head/shaft connection region assembly in accordance with this invention and the aspect of FIG. 3.

FIG. 7 illustrates an exploded section view of an alternative mounting configuration of the parts included in the connection region structure 104 in accordance with this invention and with the embodiment of FIG. 3. A hosel 400 includes an inner bore 402 that is aligned with a longitudinal axis 402*a*. The bore 402 is configured to receive the distal end of the shaft 106. An outer surface 403 is provided on the hosel 400. In this example, outer surface 403 extends parallel to the longitudinal axis 402*a* of the inner bore 402. Opposite to the opening in the hosel 400 that receives the shaft 106, an angled surface 424 is provided on hosel 400. The angled surface 424 lies at an angle A to the longitudinal axis 106*a* of the shaft 106. The angled surface 424 contacts the mounting surface 116 that is provided at an end of the shaft-attachment structure 108. The mounting surface 116 is perpendicular to axis 115 that corresponds to the standard lie angle. Additionally, the mounting surface 116 lies at the angle A to the longitudinal axis 106*a* of the shaft 106.

As shown in both FIGS. 3 and 7, a tab or projection 112 extends in a generally longitudinal direction from the mounting surface 116 of the shaft-attachment structure 108. As shown in FIG. 3, a mounting screw 408 extends through the projection 112 and into hosel 400. The mounting screw 408 is transversely aligned to the longitudinal axis 402*a*. In FIG. 7, a transverse through hole 113 is shown provided on the shaft-attachment structure 108 of the club head 102. Specifically, the transverse through hole 113 is provided on the tab or projection 112. A corresponding transversely-oriented threaded hole 413 is shown provided in hosel 400. Both the transverse through hole 113 and the corresponding transverse threaded hole 413 are configured to accommodate the mounting screw 408 (shown in FIG. 3). As would be apparent to a person of ordinary skill in the art, given the benefit of this disclosure, more than one projection 112 with a through hole 113 may be provided on the shaft-attachment structure 108; correspondingly, more than one threaded hole 413 may be provided on the hosel 400.

The projection 112 may engage a slot or channel in the hosel 400 that allows the projection 112 to lie flush with the external surface of the hosel 400. Alternatively, the projection or tab 112 may be located against an external surface of the hosel 400, as shown in FIG. 3, such that the projection 112 does not lie within the envelope of the hosel 400.

The various parts of the club head/shaft connection region structure 104 may be made from any desired or suitable materials without departing from this invention. For example, one or more of the various parts comprising the club head/shaft connection region structure 104 may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts of the club head/shaft connection region structure 104 may be made from rigid polymeric materials, such as polymeric materials conventionally known and used in the golf club industry. The various parts of the club head/shaft connection region structure 104 may be made from the same or different materials without departing from this invention. In one specific example, each of the various parts of the club head/shaft connection region structure 104 will be made from a 7075 aluminum alloy material having a hard anodized finish. The parts may be made in conventional manners as are known and used in the metal working and/or polymer production arts.

Many variations in the overall structure of the shaft, club head, and club head/shaft connection assembly are possible without departing from this invention. For example, if desired, the wedge grommet 220 could be formed as a plurality of stacked shims, each shim contributing a small, incremental lie angle adjustment to the structure of connection region structure 104.

Additionally, the releasable aspect of the connection region assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and lie angle positioning have been determined for a specific golfer, a club builder may use the determined information to then produce a final desired golf club product using permanent and conventional mounting techniques (e.g., cements or adhesives). Other variations in the club/shaft connection assembly parts and processes are possible without departing from this invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A connection region structure for connecting a golf club shaft to a golf club head to form a golf club, the connection region structure comprising:

a first end including an opening that is configured to receive a distal end of a golf club shaft;

a second end opposite to the first end, the second end including a mounting surface configured to abut a first external surface of a golf club head;

a bore extending from the first end toward the second end, wherein the bore is configured to receive the distal end of the golf club shaft and wherein the bore defines a longitudinal axis; and an outer surface extending from the first end to the second end, wherein the outer surface is parallel to the longitudinal axis of the bore and forms a part of an outer surface of the golf club, wherein the mounting surface is at a non-zero angle to a perpendicular to the longitudinal axis of the bore.

2. The connection region structure according to claim 1, wherein the first end and the bore are provided by a hosel element and wherein the second end is provided by a wedge grommet.

3. The connection region structure according to claim 2, wherein the hosel element is provided with a hosel through hole, wherein the wedge grommet is provided with a grommet through hole, and wherein the hosel through hole and the grommet through hole are aligned with one another.

4. The connection region structure according to claim 2, wherein the hosel element is provided with a hosel-to-wedge grommet attachment element that is aligned with the longitudinal axis of the bore, and wherein the wedge grommet is provided with a wedge grommet-to-golf club head attachment element that is aligned with the longitudinal axis associated with the standard lie angle.

5. The connection region structure according to claim 1, wherein the first end, the second end, and the bore are provided by an integral hosel element.

6. The connection region structure according to claim 1, wherein the second end is configured to be mechanically fastened to the first external surface of the golf club head.

7. The connection region structure according to claim 1, wherein the mounting surface of the connection region structure is provided with a rotation-inhibiting structure.

8. The connection region structure according to claim 7, wherein the rotation-inhibiting structure includes one of a projection and a cavity.

9. The connection region structure according to claim 1, wherein the non-zero angle of the mounting surface is between approximately 0.25 degrees to approximately 10 degrees.

10. The connection region structure according to claim 1, wherein the mounting surface of the connection region structure is provided with a rotation-inhibiting structure including a cavity.

11. The golf club head according to claim 1, wherein the bore includes an end wall at the second end.

12. A golf club head comprising:

a main body;

a shaft-attachment structure that projects from the main body and defines a first external surface; and a connection region structure including:

a first end including an opening configured to receive the distal end of a golf club shaft;

a second end opposite to the first end and including a mounting surface;

a bore extending from the first end toward the second end, wherein the bore is configured to receive the distal end of the gold club shaft, wherein the bore defines a longitudinal axis; and an outer surface linearly extending from the first end to the second end without any change in angle, wherein the mounting surface is at a non-zero angle to a perpendicular to the longitudinal axis of the bore, and wherein the mounting surface of the connection region structure is configured to abut the first external surface of the shaft-attachment structure.

13. The golf club head according to claim 12, wherein the first end and the bore of the connection region structure are provided by a hosel element and wherein the second end of the connection region structure is provided by a wedge grommet.

14. The golf club head according to claim 12, wherein the first end, the second end, and the bore of the connection region structure are provided by an integral hosel element.

15. The golf club head according to claim 12, wherein at least one mechanical fastener attaches the mounting surface of the connection region structure to the first external surface of the shaft-attachment structure.

16. The golf club head according to claim 12, wherein at least one of the mounting surface of the connection region structure and the first external surface of the shaft-attachment structure is provided with a rotation-inhibiting structure.

17. The golf club head according to claim 12, wherein the outer surface is parallel to the longitudinal axis of the bore.

18. The golf club head according to claim 12, wherein the non-zero angle of the mounting surface is between approximately 0.25 degrees to approximately 10 degrees.

19. The golf club head according to claim 12, wherein the connection region structure is configured to releasably couple the golf club shaft to the golf club head.

20. The golf club head according to claim 12, wherein the golf club head is an iron-type head.

21. The golf club head according to claim 12, wherein the golf club head is a driver head.

22. The golf club head according to claim 12, wherein the golf club head is a putter head.

23. A golf club comprising:

a shaft having a proximal end and a distal end;

a golf club head according to claim 11, wherein the bore of the connection region structure of the golf club head receives the distal end of the shaft.

24. The golf club head according to claim 12, wherein at least one of the mounting surface of the connection region structure and the first external surface of the shaft-attachment structure is provided with a rotation-inhibiting structure including a cavity.

25. The golf club head according to claim 12, wherein the bore includes an end wall at the second end.

26. A system for providing a non-standard lie angle for a golf club, the system comprising:

at least one golf club head;

a plurality of connection region structures, each connection region structure including:

a first end including an opening that is configured to receive a distal end of a golf club shaft;

a second end opposite to the first end, the second end including a mounting surface configured to contact a first external surface of the golf club head;

a bore extending from the first end toward the second end, wherein the bore is configured to receive the distal end of the golf club shaft and wherein the bore defines a longitudinal axis; and an outer surface linearly extending from the first end to the second end without any change in angle, wherein the mounting surface is at a non-zero angle to a perpendicular to the longitudinal axis of the bore, and wherein the non-zero angles of at least two of the plurality of connection region structures differ from one another.

27. The system according to claim 26, further including at least one golf club shaft.

28. The system according to claim 26, wherein the first surface of at least one of the golf club heads is provided as an end surface of a shaft-attachment structure that projects from a main body of the at least one golf club head.

29. The system according to claim 26, wherein, for at least one of the plurality of connection region structures, the first end and the bore are provided by a hosel element and the second end is provided by a wedge grommet.

30. The system according to claim 26, wherein the first end, the second end, and the bore of at least one of the plurality of connection region structures are provided by an integral hosel element.

31. The system according to claim 26, wherein the second end of at least one of the plurality of connection region structures is configured to be releasably secured to the first surface of the golf club head.

32. The golf club head according to claim 26, wherein the mounting surface of the connection region structure is provided with a rotation-inhibiting structure including at least one of a projection and a cavity.

* * * * *